United States Patent [19]

Stephens

[11] 4,114,133

[45] Sep. 12, 1978

[54] WORM GEAR DRIVE AND RATCHET SYSTEM

[75] Inventor: Donald Harrison Stephens, Running Springs, Calif.

[73] Assignee: Bourns, Inc., Riverside, Calif.

[21] Appl. No.: 878,191

[22] Filed: Feb. 16, 1978

[51] Int. Cl.[2] ..... H01C 10/34

[52] U.S. Cl. ..... 338/174; 74/409; 338/DIG. 1

[58] Field of Search ..... 338/174, 180, 184, 188, 338/DIG. 1; 74/425, 383, 416, 420, 459.5, 461, 409

[56] References Cited

U.S. PATENT DOCUMENTS

| | | | |
|---|---|---|---|
| 3,127,583 | 3/1964 | Hudson et al. | 338/DIG. 1 |
| 3,242,450 | 3/1966 | Bourns et al. | 338/174 |

*Primary Examiner*—C. L. Albritton

*Attorney, Agent, or Firm*—Paul H. Ware; William G. Becker

[57] ABSTRACT

A worm gear drive and ratchet system in which a flexible, two-piece, toothed drive wheel is driven by a threaded drive shaft. The two-piece, toothed drive wheel comprises identical halves that are keyed and bonded into a fixed relationship. Upon reaching a stop, gear teeth embossed on the flexible drive wheel ratchet over the threads on the threaded drive shaft.

10 Claims, 4 Drawing Figures

(Section A-A)

WORM GEAR DRIVE AND RATCHET SYSTEM

BACKGROUND OF THE INVENTION

1. Field of the Invention

This invention relates generally to the field of variable resistance devices and more particularly to ratcheting mechanisms for worm gear actuated potentiometers.

2. Description of the Prior Art

Worm gear actuated potentiometers have been known for some time. A common problem encountered in the construction of devices of this kind is in the method of provision of means by which excessive rotation of the driving element can be accommodated without damage to internal elements. In most applications it is necessary to provide a stop. Lacking such a stop provision, the resistance ratio may suffer discontinuous changes as a result of the travel of the wiper into and through open circuit conditions. Worm gear actuated potentiometers generally provided positive stops which prevent the wiper from rotating through such a distance as to lose contact with the resistance element. Thus the problem of discontinuous change of the resistance ratio was solved by limiting the wiper travel. Another problem, however, was thus generated because continued rotation of the drive screw after a limit stop was reached would cause stripping of the gears on the driven rotor carrying the wiper, thus causing destruction of the device. In some of the later devices, friction clutches were employed such that when the wiper reached a limit stop, the friction clutch would allow slippage so as not to damage the interior elements as a result of excessive rotation of the driving screw. Some of these devices, however, also allowed slippage under unpredictable conditions, thus operation became erratic and unreliable. Many different ratcheting devices have been employed in attempts to solve the problems presented. Most have either presented new problems or only partially solved the problems presented, or both. Most of these devices have thus met special needs as presented by specific problems and have therefore served narrow purposes. These prior art devices, among other disadvantages, have been unreliable and unpredictable in operation under continued use and have been expensive and complicated to manufacture. Some of these prior art devices have been described in the following listed patents that were brought to the attention of the applicant through a novelty search conducted in the United States Patent and Trademark Office 1. No. 3,497,856 — "Adjustable Potentiometer" — L. W. Scheel
2. No. 3,242,452 — "Clutch Means for Multiple Turn Variable Resistor" — A. A. Grunwald, et al.
3. No. 3,768,325 — "Multiturn Adjustment Potentiometer Ratcheting Mechanism" — L. Kucharski, Jr.
4. No. 3,683,308 — "Potentiometers" — A. L. Hamill
5. No. 3,569,896 — "Ultrathin Miniature Potentiometer with Recessed Drive Means" — W. D. Kirkendall
6. No. 3,522,573 — "Potentiometer Shaft Retention" — R. Michik
7. 3,522,572 — "Gear Adjusted Potentiometer" — R. Michik
8. No. 3,208,024 — "Potentiometer Construction" — H. Enos et al.

9. No. 3,099,810 — "Miniature Potentiometer" — H. Habereder
10. No. 3,416,119 — "Variable Resistance Control with Clutch Mechanism" — J. Van Beuthuysen
11. No. 3,115,614 — "Miniature Potentiometer with Stop Mechanism" — H. Habereder
12. No. 3,701,070 — "Worm Gear Actuated Potentiometer " — K. B. Baldwin et al.
13. No. 3,582,857 — "Worm Driven Adjustable Potentiometer" — J. F. Kishel
14. No. 3,639,878 — "Adjustable Potentiometer with Contactor Ratchet and Central Post Securing Means for Baseplate" — L. W. Scheel
15. No. 3,478,294 — "Variable Resistor"— W. D. Kirkendall
16. No. 3,446,085 — "Variable Resistor "— L. Ginsberg
17. No. 3,384,851 — "Gear Adjusted Potentiometer"— W. H. King
18. No. 3,378,803 — "Variable Resistance Potentiometer" — C. Yungblut et al It would thus be a great advantage to the art to provide an improved ratcheting mechanism for a worm gear actuated potentiometer;

It would be another great advantage to the art to provide an improved ratcheting mechanism for a worm gear actuated potentiometer which is simple and inexpensive to manufacture;

A further desirable advantage to the art would be to provide a ratcheting mechanism for a worm gear actuated potentiometer which is predictable and reliable;

It would also be a great advantage to the art to provide a worm gear actuated potentiometer showing the advantages of ratcheting to prevent interior damage to the elements that will have a long operating life.

SUMMARY OF THE INVENTION

It is an object of the present invention to provide an improved ratcheting mechanism for a worm gear actuated potentiometer;

A further object of the present invention is to provide an improved ratcheting mechanism for worm gear actuated potentiometers which is simple and inexpensive to manufacture;

A still further object of the present invention is to provide a ratcheting mechanism for a worm gear actuated potentiometer which is predictable and reliable;

An additional object of the present invention is to provide a construction and arrangement which comprises a minimum number of parts and which parts are themselves simple and efficient in operation over prolonged periods of use.

In the accomplishment of these and other objects a worm gear actuated potentiometer is provided in which the rotary element of the invention includes a flexible, two-piece, toothed wheel comprising identical halves that are keyed and bonded into a fixed relationship. This two-piece, toothed drive wheel is driven by a threaded shaft. When this wheel is driven to a stop, the flexible material of which the wheel is fabricated distorts so as to permit ratcheting over the threaded shaft. Since the two-piece wheel is driven from both the top and bottom, axial loads are evenly distributed. Both pieces of the two-piece toothed drive wheel are identical, thus requiring but one mold in the fabrication process.

BRIEF DESCRIPTION OF THE DRAWINGS

Further advantages and features of the present invention will be more fully apparent to those skilled in the art to which the invention pertains from the ensuing detailed description thereof, regarded in conjunction with the accompanying drawings wherein like reference characters refer to like parts throughout and in which:

FIG. 2 is a plan view of which FIG. 1 is a sectional view thereof.

DETAILED DESCRIPTION

Although specific embodiment of the invention will now be described with reference to the drawings, it should be understood that such embodiments are by way of example only and merely illustrative of but a small number of the many possible specific embodiments which can represent applications of the principles of the invention. Various changes and modifications obvious to one skilled in the art to which the invention pertains are deemed to be within the spirit, scope, and contemplation of the invention as further defined in the appended claims.

Figure 1:
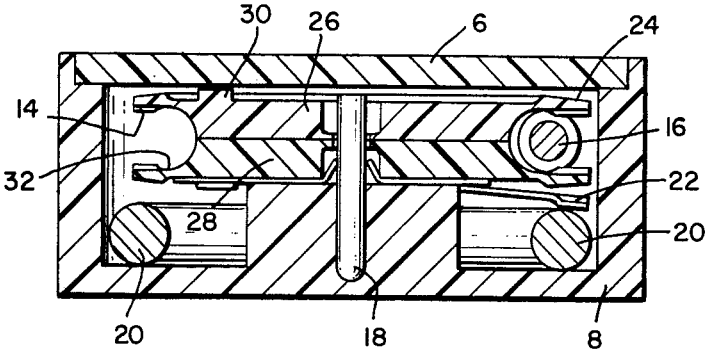
FIG. 1 is an interior cross-sectional view of the mechanism of the invention in an unflexed condition of the drive wheel.
Figure 2:
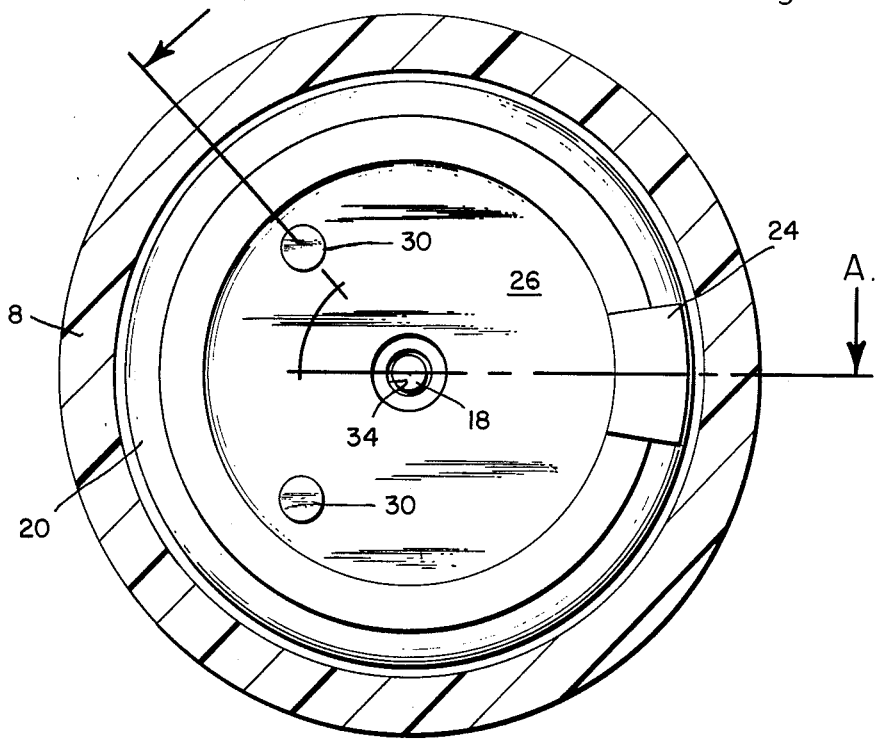
Figure 3:
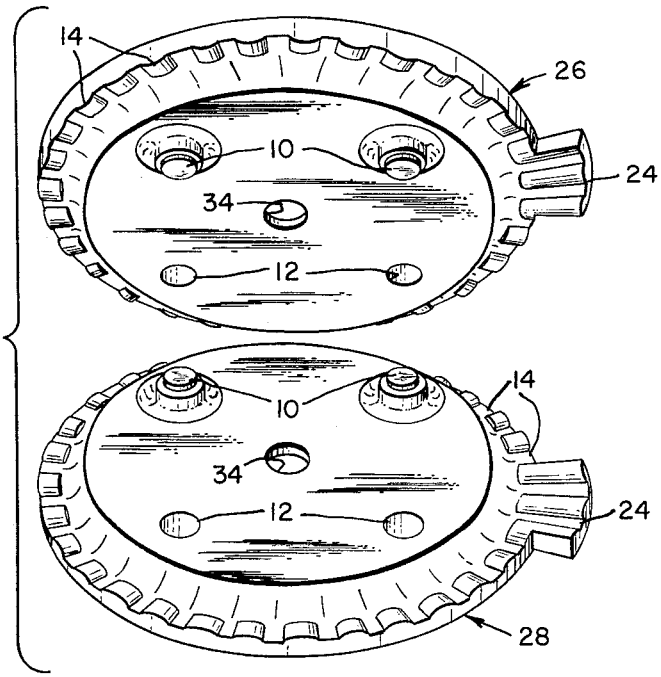
FIG. 3 is a perspective view showing the identical halves of the two-piece, toothed wheel of the invention.

Referring to FIG. 1 with greater particularity, there is illustrated an interior cross-sectional view of the mechanism of the invention in an unflexed condition of the drive wheel. A potentiometer having a resistive element 20 is shown as housed in a housing 8 that has a lid 6. A contact spring 22 is shown in contact with the resistive element 20. The bottom gear half of the drive wheel is denoted by the numeral 28 while the top gear half has been denoted by the numeral 26. A metal collector pin 18 is shown as being incident through both top gear half 26 and bottom gear half 28 and into the body of the housing 8. The end of the drive shaft or worm is denoted by the numeral 16 and a mechanical stop, as better seen in FIGS. 2 and 3, is denoted by the numeral 24. The numeral 30 denotes a contact spring retention boss that maintains the integrity of the contact spring as is well-known in the art. The gear teeth on the drive wheel are denoted by the numeral 14 and a flex point on the drive wheel seen in profile is denoted by the numeral 32.

Referring to FIG. 2, the stop 24 may be more clearly identified. The center hole through which metal collector pin 18 fits is denoted by the numeral 34 and in this plan view it is seen that there are two contact spring retention bosses 30.

An examination of the perspective drawing of FIG. 3 may give a much better notion as to how the two halves of the drive wheel fit together. It is important to note that they are identical halves, therefore only one mold is required. Tolerance differences are eliminated since both halves are made in the same mold. Again, the mechanical stop has been denoted by the numeral 24 while the top gear half has been identified by the numeral 26 and the bottom gear half identified by the numeral 28. The center hole through which metal collector pin 18 fits is again denoted by the numeral 34. Locator pegs 10, which fit into locator holes 12, have been shown. These are the means by which the two halves are mated before permanent bonding. The gear teeth are again shown and identified by the numeral 14.

Figure 4:
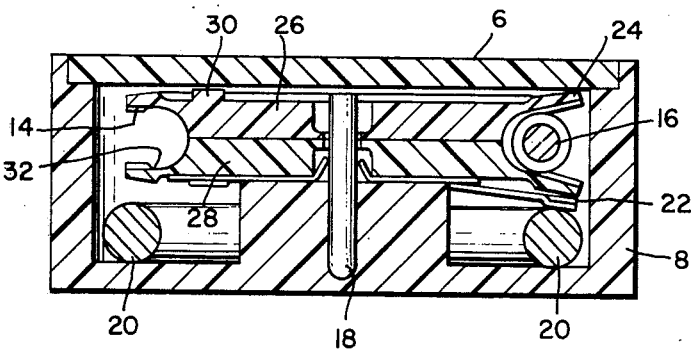
FIG. 4 is an interior cross-sectional view of the mechanism of the invention showing a flexed condition of the drive wheel.

Referring now to FIG. 4, the flexing of the wheels to allow the gear teeth to ride over the worm or the drive shaft gearing is illustrated. The stop 24 is shown as being flexed toward the top toward the lid 6. The drive wheel has thus flexed apart in order to allow the ratcheting of the worm in respect to the gear teeth 14. The teeth have been designed so as to permit easy ratcheting but still to provide positive engagement when the direction of the shaft is reversed.

Thus there has been described a worm gear drive potentiometer ratchet system that will provide positive ratcheting, yet never becomes disengaged from the main drive gear. Great improvements in reliability, flexibility, maintainability, and ease of operation have been provided through the novel advantages of the invention.

It is pointed out that although the present invention has been shown and described with reference to particular embodiment, nevertheless various changes and modifications obvious to one skilled in the art to which the invention pertains are deemed to lie within the purview of the invention.

What is claimed and desired to be secured by Letters Patent of the United States is:

1. A worm gear drive and ratchet system mounted in a housing and having a two-piece, toothed drive wheel comprising:

identical top and bottom gear halves having at least two locator holes and a center hole in each gear half;

at least two locator pegs on each of said top gear half and said bottom gear half to be received into said locator holes;

gear teeth molded into each of said top gear half and said bottom gear half; and a mechanical stop molded onto said identical top and bottom gear halves.

2. The worm gear drive and ratchet system of claim 1, wherein said top and bottom gear halves open and flex so as to permit ratcheting thereover when a drive shaft contacts the mechanical stop.

3. The worm gear drive and ratchet system of claim 1, wherein said at least two locator pegs are adapted to permanent attachment of the top and bottom gear halves.

4. A worm gear actuated potentiometer comprising in combination:

flexible, two-piece toothed drive wheel means to be driven by a threaded shaft;

keying means provided on each piece of said flexible, two-piece toothed drive wheel means to effect a predetermined positional relationship between said each piece of said two-piece toothed drive wheel means;

bonding means provided on each piece of said flexible, two-piece toothed drive wheel means to fix the predetermined positional relationship between said each piece of said two-piece toothed drive wheel means;

identical half-wheel means comprising said flexible, two-piece toothed drive wheel means;

mechanical stop means molded onto each of said identical half-wheel means.

5. The worm gear actuated potentiometer of claim 4, wherein said identical half-wheel means includes at least two locator holes.

6. The worm gear actuated potentiometer of claim 5, wherein said identical half-wheel means includes at least two locator pegs.

7. The worm gear actuated potentiometer of claim 6, wherein said keying means comprises said at least two locator holes and said at least two locator pegs.

8. The worm gear actuated potentiometer of claim 4, wherein said fixed predetermined positional relationship between said each piece of said two-piece toothed drive wheel means permits said two-piece drive wheel to flexibly partially open between said identical half-wheel means so as to permit a threaded drive shaft to cause ratcheting when the drive shaft contacts said mechanical stop.

9. The worm gear actuated potentiometer of claim 4, wherein said identical half-wheel means comprises:

means for keying two of said identical half-wheel means in predetermined positional relationship;

means for bonding two of said identical half-wheel means in said predetermined positional relationship.

10. The worm gear actuated potentiometer of claim 9, wherein said identical half-wheel means comprises locator hole means and locator peg means to be received into said locator hole means so as to effect a predetermined positional relationship between two of said identical half-wheel means and to fix that predetermined positional relationship.

* * * * *